US005452897A

United States Patent [19]

Mick

[11] Patent Number: 5,452,897

[45] Date of Patent: Sep. 26, 1995

[54] LASER AIDED PUTTER ALIGNMENT SYSTEM

[75] Inventor: Phillip J. Mick, Tarzana, Calif.

[73] Assignee: Sceptre Golf Company, Vista, Calif.

[21] Appl. No.: 991,147

[22] Filed: Dec. 16, 1992

[51] Int. Cl.[6] ..... A63B 69/36

[52] U.S. Cl. ..... 273/186.2; 273/194 A

[58] Field of Search ..... 273/181 R, 181 H, 273/35 R, 35 A, 183.1, 186.1, 186.2, 186.3, 192, 194 R, 194 A

[56] References Cited

U.S. PATENT DOCUMENTS

| | | | |
|---|---|---|---|
| 3,680,860 | 8/1972 | Elkins | 273/32 R |
| 3,802,709 | 4/1974 | Elkins | 273/186 A |
| 3,826,495 | 7/1974 | Elkins | 273/32 R |
| 4,251,077 | 2/1981 | Pelz et al. | 273/186 A |
| 4,367,877 | 1/1983 | Gibson et al. | 273/164 |
| 4,708,346 | 11/1987 | Pierce | 273/164 |
| 4,809,984 | 3/1989 | Tindale | 273/183 E |
| 4,979,745 | 12/1990 | Kobayashi | 273/186 R |
| 4,997,189 | 3/1991 | Perkins | 273/181 H |
| 5,161,802 | 11/1992 | Daechsel | 273/186.3 |
| 5,169,150 | 12/1992 | Tindale | 273/164 |

FOREIGN PATENT DOCUMENTS

| | | | |
|---|---|---|---|
| 52-51227 | 4/1977 | Japan | 273/186.1 |

OTHER PUBLICATIONS

Aug. 1971 issue of Golf Digest, article entiled "The Search for the Perfect Putter", by Dick Aultman.

*Primary Examiner*—William E. Stoll
*Attorney, Agent, or Firm*—Baker & Daniels

[57] ABSTRACT

A method and an apparatus for determining an individual's inaccurate aim in hitting a golf ball. A mirrored surface is disposed at a ball striking surface of a golf club and a golf ball on a location on a generally horizontal surface. The individual, while assuming a normal golf ball hitting stance on the generally horizontal surface, addresses the golf ball with the golf club and aligns the golf club adjacent to the golf ball in a direction believed to be the correct direction of a target. The golf ball is removed and a beam is directed to the mirrored surface. The deviation between a line normal to the mirrored surface and a line between the location and the target is measured, using the beam, as it is reflected from the mirrored surface, to determine the amount of the deviation.

2 Claims, 2 Drawing Sheets

FIG. 4
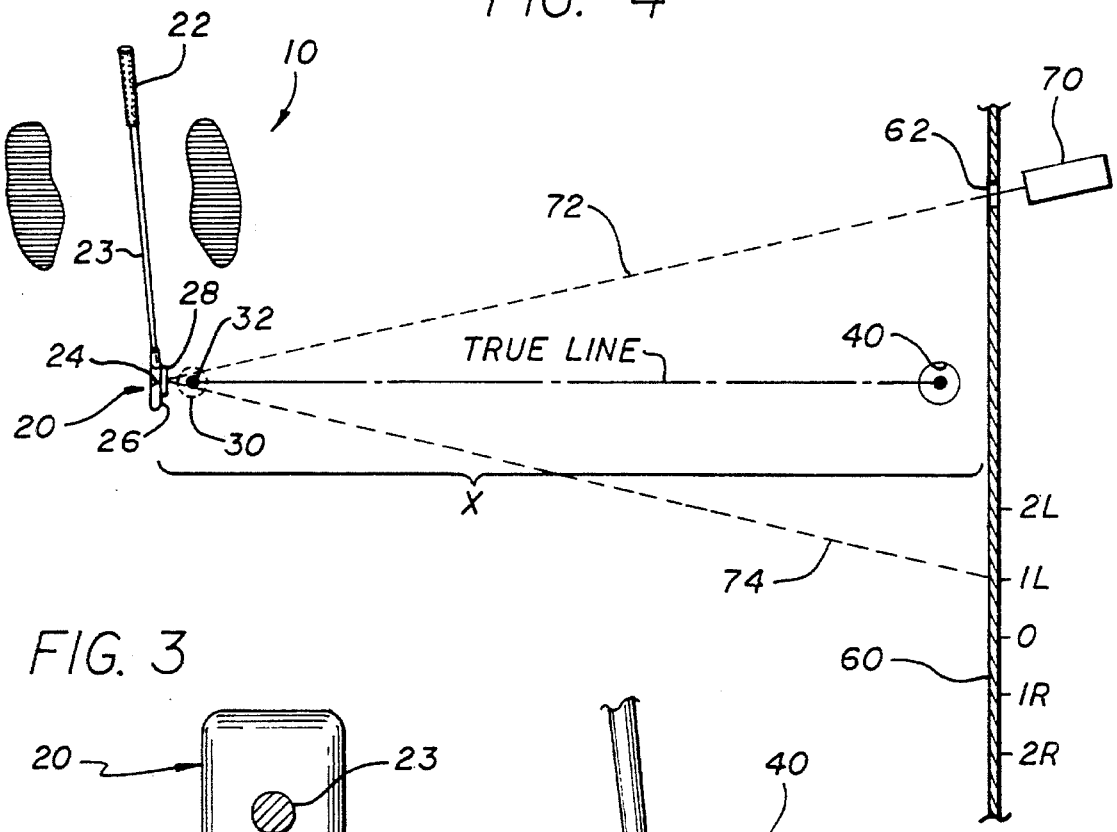
FIG. 3
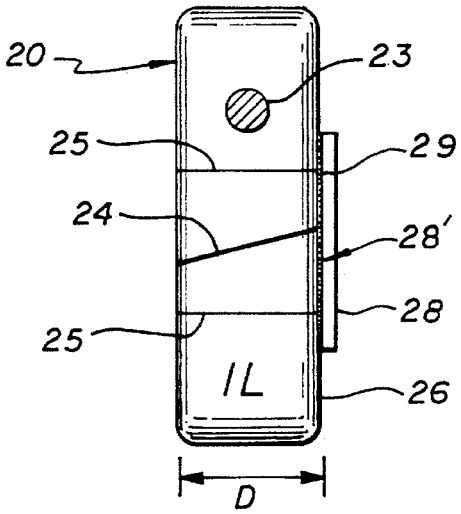
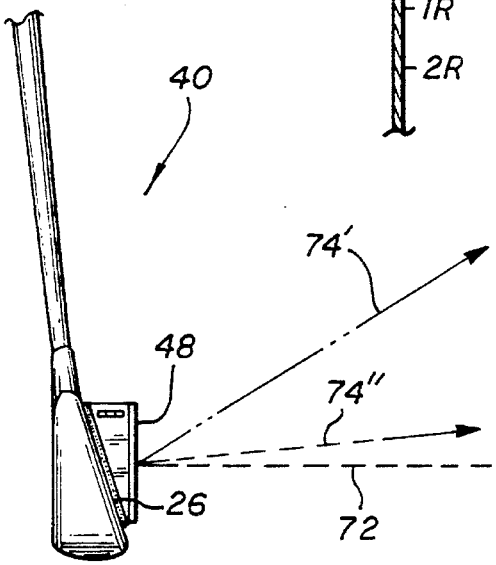
FIG. 5
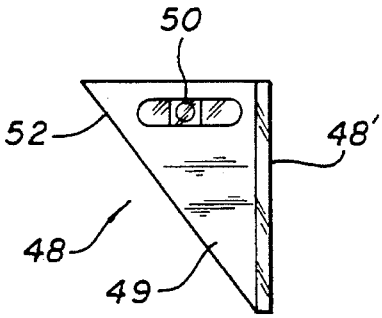
FIG. 6

LASER AIDED PUTTER ALIGNMENT SYSTEM

FIELD OF THE INVENTION

This invention relates to measuring and correcting for individual sighting errors as it relates to the game of golf, and in particular to a system for measuring and compensating for an individual's sighting error when using a golf club, such as a putter, to hit or putt a golf ball.

BACKGROUND OF THE INVENTION

Alignment lines or other sighting marks have been used on putters and other golf clubs in the past. Such alignment lines have been provided to aid the golfer in hitting a golf ball in a proper straight line between the golf ball and the golf ball cup. Assuming the golf ball were on a flat surface, if the alignment line was correctly aimed at the cup, it was often believed the golfer should be able to putt the golf ball into the cup with little problem.

In the actual practice, however, the golfer would be more apt to miss than to make his or her putt. It was often felt, in the prior art, that the golfer's failure to make the putt was due to an improper swing. That is to say, it was assumed that when the golf club was initially properly aligned toward the cup, it was correctly aligned, but when the golfer swung through the putt, the golfer would rotate the shaft of the putter one way or the another, so that it was no longer in a proper alignment to the cup, and the ball, upon being hit, would not fall into the cup.

It has been determined, however, the failure to make a putt, can also be due to the fact that individuals have inherent sighting errors so that when they think the alignment lines on putters or other golf clubs are properly aligned towards the golf cup, in fact the golf club is misaligned.

In the prior art, it is know to test golfers for their sighting errors and also to place a sighting error correction stripe or line on a golf club putter to compensate for the individual's sighting error. See, for example, U.S. Pat. Nos. 3,680,860 and 3,826,495 to Elkins. The Elkins technology is over 20 years old, but apparently has not met with commercial success. The applicant herein believes that the Elkins idea of compensating for an individual's sighting error is basically sound, however, the Elkins apparatus set forth in his issued patents is far to complicated for convenient use and, moreover, it is believed to induce additional errors which are not or cannot be compensated for.

It is an object of the present invention, therefore, to provide a convenient method and apparatus for correcting the sighting error of an individual in the context of using a golf club to try to place a golf ball in a golf ball cup. It is another object to reduce the errors which can be induced by prior art apparatus and furthermore to simplify the apparatus to make it easier to use in the context of pro-shop, where a golfer might be fitted for golf clubs.

BRIEF DESCRIPTION OF THE INVENTION

The present invention provides a method for correcting an individual's inaccurate aim when hitting a golf ball. The method comprises the steps of disposing a mirrored surface at or parallel to the normal striking surface of a golf club. A golf ball is placed at a location on a surface and an individual, while assuming a normal golf ball hitting stance on the surface, addresses the golf ball with the golf club and aligns the golf club adjacent the golf ball in a direction which the golfer feels is the proper direction of a target, i.e., a golf cup. The golf ball is then removed and a beam of collimated light is directed toward the mirrored surface. The deviation between a line normal to the mirrored surface and a line between the location and the target is measured by observing the direction which the collimated beam of light is reflected from the mirrored surface. The amount of the deviation is indicative of the individual's sighting error and the individual can then acquire golf club which have corrected alignment lines which compensate for the golfer's sighting error.

BRIEF DESCRIPTION OF THE DRAWINGS

FIG. 3 illustrates a top of view of a putter which has been provided with a corrected sight line to compensate for the individual's sighting error;

FIG. 4 illustrates, again in simplified form, a top view another embodiment of the sighting error measuring system;

FIG. 5 is a side view of a golf club iron with a mirror on its golf ball striking surface; and FIG. 6 is a side view 4 showing the mirror of FIG. 5 in greater detail.

DETAILED DESCRIPTION

Figure 1:
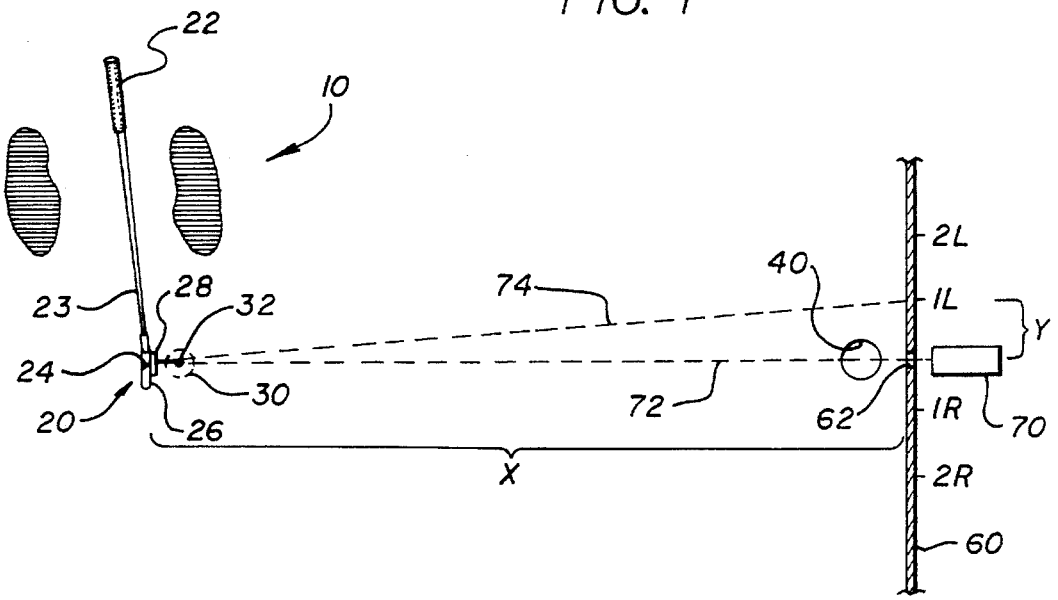
FIG. 1 illustrates, in a simplified form, a top view of the apparatus and method for measuring an individual's sighting error in connection with the game of golf, according to the present invention.
Figure 2:
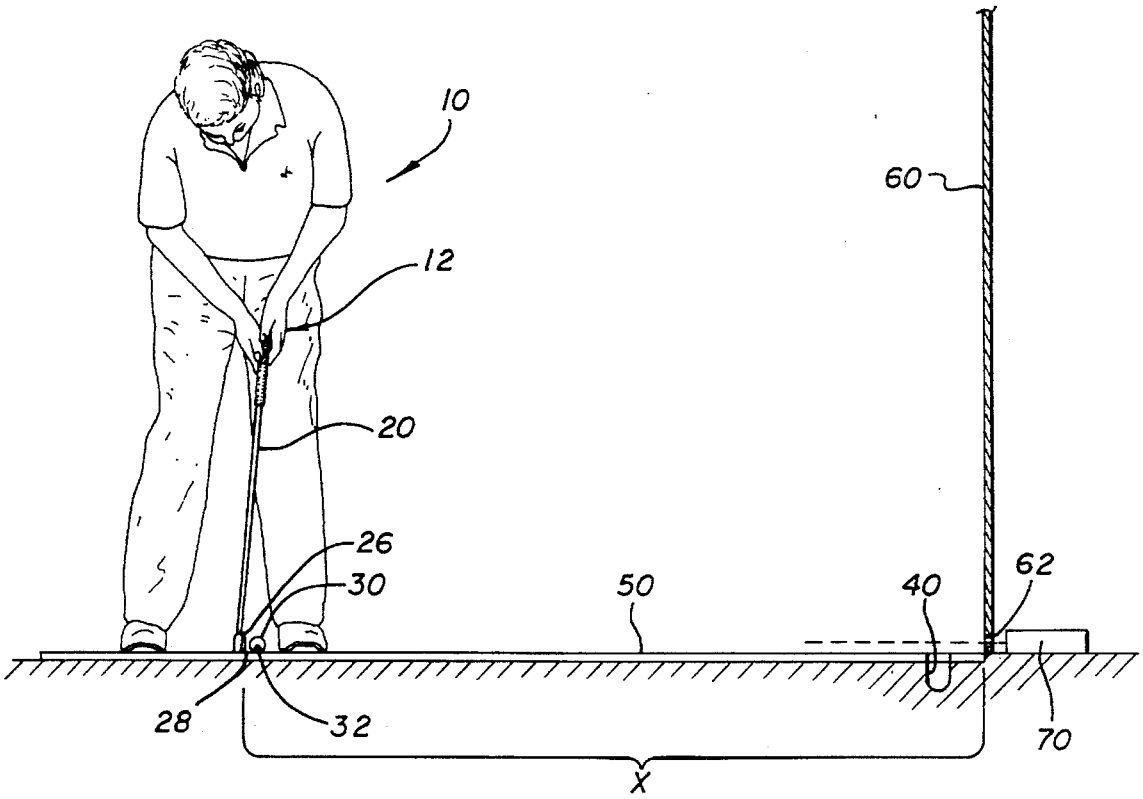
FIG. 2 is a side view otherwise corresponding to FIG. 15.

FIG. 1 shows, in a schematic plan view and FIG. 2 shows in a side view, an apparatus which may be used to measure and correct for the sighting error of an individual 10 in the context of playing the game of golf. Those skilled in the game of golf will note that the golf club 20 shown in FIGS. 1 and 2 is a putter, but it will be appreciated that the apparatus and method of this invention can be used with other golf clubs including woods and irons, as will be described.

The individual 10, shown by his or her footprints in FIG. 1, assumes a usual normal golf ball addressing stance, gripping the handgrip 22 of a golf club, here shown as putter 20, with his or her hands 12 in the usual manner. The golf club 20 might be the individual's favorite putter 20 which may or may not have an alignment mark 24 inscribed thereon, or it might be a putter or other instrument, such as a testing device, provided to the individual for the purpose of testing the person's sighting error. Before the individual 10 takes the stance shown in FIGS. 1 and 2, however, the putter 20 is altered (assuming that it is the golfer's putter and not a testing device which is being used), in a very minor way by the addition of a mirror 28 placed at its normal ball striking surface 26. The mirror 28 has a mirrored surface 28' at its rear surface. If the putter belongs to the individual, then the mirror 28 can be temporarily affixed to ball striking surface by means of a suitable adhesive 29 (FIG. 4), such as rubber cement. If the testing device 20 is provided to the individual being tested, then, of course, the mirror may be permanently affixed to surface 26 or surface 26 itself may be sufficiently polished to provide a mirror-like surface which can reflect light. Otherwise, the testing device 20 preferably looks and feels like a conventional golf club, preferably a putter. It is believed that the impact of sighting error, which will become apparent to the individual 10 subjected to the test, will have a much bigger impact on the individual if they use their own putter 20, since they will see with their own eyes the effect of their sighting error has had in causing inaccurate putts or hits in the past.

In any event, the golfer addresses ball 30, assuming the individual's normal golfing stance, and aligns the head of the golf club 20 in what he or she feels is an appropriate position for striking ball 30 into golf cup 40. Of course, ball cup 40 need not be an actual golf cup, but might only be a target on surface 50, but is believed that the individual might feel comfortable and that more accurate and repeatable results will be obtained if the environment in which they are being tested by the present invention is as realistic as possible. Thus, it is preferred that the ball 30 be placed at a predetermined location 32 on a horizontal surface 50 which mimics a putting green, for example. In the mimicked putting green 50 is a target 40, which is preferably in the form of an appropriately sized golf cup.

Behind the golf cup 40 is disposed a backdrop 60 which has a small hole therein 62 preferably in alignment with both the center of cup 40 and location 32. Through that hole 62 can be directed a beam of collimated light 72, preferably from a laser device 70, towards the mirrored surface 28 on putter 20.

If the individual has aligned the face 26 of the putter 20 in any direction other than precisely normal to the true line between point 32 and the center of target 40, that misalignment will be quickly revealed when the ball 30 is removed and the laser 70 is energized. Then the reflected laser beam 74 will strike a point on backdrop 60 either to the right or the left of the center of target 40, unless, of course, the individual has no sighting error at all. The reflected laser beam 74 can also strike backdrop 60 above or below hole 62, but that sort of misalignment is of much less concern than right or left misalignment.

In FIGS. 1 and 2, the distance between the face of the golf club 26 and the backdrop is identified by the letter X while the distance between the center of the hole and the point at which the reflected collimated light 74 strikes the backdrop 60 is identified by the letter Y (FIG. 1 only). The tangent of twice the angle of deviation, that is, twice the sighting error, is equal to Y divided by X. Of course, location 32 and target 40 can be preselected, and therefore the distance X can be a preselected distance. As such, the backdrop 60 can be calibrated to the left and right of target 40 with calibration marks associated with indicia such as 1L, 2L or 1R, 2R to indicate, for example, one or two degrees left deviation or one or two degrees right deviation. Of course, the indicia need not be tied to degrees, but rather can be in any arbitrary unit or units. The reflected laser beam 74 in FIG. 1 indicates that the individual being tested has a sighting error of one unit to the left (if it units equal degrees, it is one degree to the left). The test should be repeated several times to gain confidence that the individual's sighting error has been correctly measured.

A line normal to surface 26 would subtend incident beam 72 and reflected beam 74. Thus, the point of impact of the reflected beam 74 on backdrop 60 tends to exaggerate the error naturally, due to the geometries involved. This has the advantage of making the error larger and, thus, easier to notice and determine.

Once the individual's sighting error deviation is known, then the golfer can be outfitted with clubs which have been marked with a sighting or alignment marker or line 24 which has been placed so as to compensate for their sighting error, such is shown on the golf club depicted in FIG. 3. FIG. 3 is a top view of a putter head with a sighting line 24 placed so as to compensate for the individual 10 depicted in FIGS. 1 and 2. The putter is inscribed with the indicia 1L to indicate that its sight line 24 is one unit off to the left (the angle of slight line 24 is exaggerated in FIGS. 1 and 3 for ease of illustration).

Of course, relatively small sighting errors can cause significant putting errors, especially over long putting distances. Thus, is may be desired to provide golf clubs with even finer sighting corrections such as 0.5L, 1.5L, 0.5R, 1.5R and the like. Finer corrections than one unit may not be needed if the arbitrary unit selected is sufficiently small to begin with.

When an individual's sighting error is measure according to the invention as described above with reference to FIGS. 1 and 2, the individual's sighting error should be measured a number of times to check for the repeatability of the measurement. It may be desired to have the individual close their non-dominant eye if they have trouble obtaining consistent measurements using both eyes. Of course, in such a case, the person should also close their non-dominant eye when lining up the golf club to strike the ball after they have received a corrected golf club as shown in FIG. 3, during actual golf play.

It is believed that an individual's sighting error will change or vary with time. Thus, every time a golfer is fitted for a new club, their sighting error should be checked with the present invention.

It may be necessary to sight-check the golfer for different clubs since a golfer often stands different distances from the ball 32 depending on the club selected. A golfer's currently used, but sight-corrected, putter can be brought to a pro-shop, mirror 28 can be temporarily affixed to surface 26 and they can be tested as described above. If they are not correctly lining up their putter adjacent ball 30, that will be revealed by the reflected collimated beam of light 74, and either additional correction or less correction may be indicated.

Indeed, in the context of professional players and serious amateur players, it may be desirable for them to check their sighting error before every round of golf and to select their clubs for a particular days use based upon their sighting error as measured that very day. That is, such golfers may find it desirable to own different sets of clubs having differing amount of sight correction factored into their alignment markers or lines 24.

In golf, it is permissible under the rules, for a caddie to assist the golfer in lining up a golf club for putting, for example. Of course, when the golfer approaches the golf ball for the purpose of hitting a putt, line 24 is not actually correctly directed at the golf hole 40, but rather merely appears to be correctly aligned at the golf hole by the golfer due to the golfer's sighting error. If a caddie were to try to assist the golfer by aligning up corrected sight line 24 with the hole 40, that would induce an error rather than eliminate an error since, as previously indicated, line 24 is not actually aimed at hole 40 when the golf club is properly aligned, but rather it merely appears to be properly aligned due to the individual's sighting error.

Thus, a caddie should preferably use supplementary sighting lines such as lines 25 shown in FIG. 3 which are preferably disposed perpendicular to surface 26. Sighting lines 25 are preferably of a lighter weight than is sight-corrected sighting line 24 and are preferably disposed on the order of one and a half inches apart, or about the diameter of a standard golf ball, on either side of line 24. Corrected sight line 24 should be arranged so that it is disposed halfway between sight lines 25 at the face 26 of the golf club 20, so that when the golfer addresses the ball in preparation to making a putt, line 24 will be directed to the center of the ball while lines 25 are directed to the edges of the ball.

Sighting errors can be further reduced by increasing the depth D of the golf club so as to lengthen sight line 24. However, in practical terms, a golfer's selection of golf clubs, and particularly putters, can be based as much upon aesthetic factors as upon the practicality of having corrected sighting lines. Thus, while it may be preferable to provide a golf club with as long a sighting line as practical, aesthetics will often dictate that the club have a shorter depth D. Even so, the present invention will improve a golfer's ability to align his or her golf club with the ball when striking it, whether they are teeing off and using a wood, or putting on a green.

FIG. 4 depicts an alternate embodiment of the invention. FIG. 4 is very similar to FIG. 1, except in this case the collimated beam of light, for example, from laser 70 does not emanate from directly behind hole 40 but is rather from one side. In practicing this invention, I prefer to use the embodiment FIGS. 1 and 2, since it makes the individual's sighting errors more apparent.

FIG. 5 is side representational view of a golf club iron 40. The golf club iron has a ball striking surface 26 which is rotated back from the vertical in order to give a golf ball a certain amount of lift when it is struck. Golfers will recognize that the iron 40 represented in FIG. 5 would give a golf ball quite a bit of lift and, therefore, it is a high numbered iron such as a nine iron. Golf club woods also have their golf ball striking surfaces 26 rotated rearwardly so as to give the golf ball a certain amount of lift when it is struck. In any event, when practicing the instant invention, if a conventional mirror having planar and parallel front and rear surfaces were used, then the reflected beam from the laser would be reflected upwardly as shown by the reflected beam identified as 74', in addition to right or left of the target. Since the instant invention may be well practiced in a golf-pro shop, if a conventional mirror is used, beam 74' might well strike the ceiling of the golf-pro shop before it encounters back-drop 60. Thus, when golf clubs having rearwardly rotated ball striking surfaces 26 are tested using the instant invention, if the amount of rearward rotation is so much as to make it difficult or impossible to make the reflected beam 74 strike backdrop 60, then a triangular shaped mirror 48 may be used so as to cause the reflected beam to be reflected closer to the horizontal plane in which the incident beam 72 occurs, such as shown by reflected beam 74" in FIG. 5.

FIG. 6 is a detailed view of mirror 48. It preferably includes a mirror with mirrored surface 48' mounted on a triangular block 49 which has a surface 52 for mounting on surface 26 of the iron shown in FIG. 5.

Those skilled in the art will appreciate that according to the invention as described with reference to FIGS. 1–5, it is assumed that the reflective surfaces 28' and 48' of mirrors 28 and 48 are disposed perpendicular to a vertical plane defined by the incident beam 72. That is to say, it is okay if the reflective surface of 28', 48' of mirrors 28, 48 rotate backwards, so long as they are parallel to the ball striking surface in a horizontal plane taken through the golf club head 26 and the mirror 28 (i.e., as shown in the plan view of FIG. 3, for example). If the surface of mirror 28 is not parallel to the golf club striking surface 26, in plan view, then that lack of parallelism will induce errors in the reported sighting error according to the invention as heretofore described. However, it is possible to modify the instant invention so as to place the reflective surface 28' of the mirror 28 at an angle to the ball striking surface 26 in plan view and then to compensate for that angle by either placing the laser 70 off to one side and/or, placing the indica off to one side as shown in FIG. 4, for example. Such a modification is not preferred since it complicates the shape of the mirror 28 and would highly complicate the shape of mirror 48. In short, I prefer that mirror 28 is to be disposed parallel to the surface 26, in plan view, but it is possible to modify my invention to have mirror 28 not parallel, but at a predetermined angle, in plan view, to surface 26.

Moreover, if mirror 48 is incorrectly affixed to the face 26 of golf club 40, that error will induce errors in measuring the golfer's sight line error. I believe that if triangular shaped mirrors 48 are to be used, then they should be equipped with a conventional bubble level device 50 such as found in a conventional carpenter's level, to ensure that the triangular device 48 is squarely placed on surface 26. In order to attempt to keep the apparatus and method fool-proof, I prefer to use planar mirror 28, such as that shown in FIGS. 1–3.

The present invention provides a number of improvements over the prior art. First, the device shown in FIGS. 1 and 2 is very simple to build and is very easily aligned. In order to assure proper alignment, the laser should be positioned so that its collimated beam of light 72 passes over the center of hole 40 and also over location 32, assuming the embodiment of FIGS. 1 and 2 is used. Those locations can be very easily checked by placing a piece of stiff paper or cardboard over hole 40 and over location 32 to check the location of collimated beam 72. Indeed if ambient lighting is not to bright, the location of the beam will be easily seen once it is energized even without using a reflective test surface, such as a piece of cardboard, due to dust particles in the air.

The present invention also provides the advantage that the individual's sighting error can be checked using their own clubs by temporarily adhering a small mirror 28 to the ball striking face 26 thereof to check for their sighting error. This also makes it very apparent to the individual that their sighting error is causing an alignment problem in the game of golf as opposed to using a special apparatus, such as that shown in the prior art, whose tests results may be less convincing. Furthermore, the present invention does not utilize an apparatus on the floor which can be tripped over, possibly causing injury to a golfer or causing the apparatus to become misaligned. Finally, the present invention does not induce a golfer to approach the ball 30 with any particular stance as the prior art may by use of buttons which might induce a golfer to take a particular stance before being tested.

The present invention provides a simpler, more economical, and more easily maintained apparatus and also an apparatus which is less likely to induce or create errors in testing for an individual's sighting error than does the prior art as exemplified by U.S. Pat. No. 3,680,860, for example.

Having described the invention in connection with certain embodiments, further modifications will now suggest themselves to those skilled in the art. Therefore, the invention is not to be limited to the inventions as described, except as required by the appended claims.

I claim:

1. A method for determining an individual's inaccurate aim in hitting a golf ball and compensating therefor comprising the steps of:

disposing a mirrored surface at a ball striking surface of a golf club;

placing a golf ball on a location on a generally horizontal surface;

the individual, while assuming a normal golf ball hitting stance on the generally horizontal surface, addressing said golf ball with said golf club and aligning said golf club adjacent to said golf ball in a direction the individual believes to be the correct direction for propelling the ball toward a target;

removing said golf ball;

providing a backdrop with a hole in it adjacent said target and directing a beam of light through said hole to said mirrored surface;

through the use of a beam as it is reflected from said mirrored surface, determining the direction and measuring the amount of deviation of a first line normal to said mirrored surface from a second line extending between said location and said target;

applying first indicia on said backdrop corresponding to numbers of units of deviation of a first line from a second line;

applying a compensating sighting line on said golf club based upon the results of the step of determining the direction and measuring the amount of deviation of said first line normal to said mirrored surface from said second line extending between said location and said target; and applying second indicia on said golf club indicating the amount of units of deviation of said first line from said second line.

2. A method for detecting and correcting alignment errors in a golfer's putting stroke comprising the steps of:

disposing a light reflecting surface on the striking surface of a putter:

orienting said putter in accordance with a said golfer's perception to direct a golf ball along a desired trajectory while said golfer has assumed his normal golf ball putting stance;

directing a beam of light to said light reflecting surface whereby a reflected beam of light is generated:

measuring the amount of units deviation of said reflected beam of light from said desired trajectory;

applying a compensating sighting line on the putter based on the results of said amount of measured deviation to compensate for misalignment errors in a golfer's putting stroke; and applying an indicia on said golf club to indicate amount of units of deviation.

* * * * *